United States Patent [19]

Millett et al.

[11] 3,938,359

[45] Feb. 17, 1976

[54] LOCK ASSEMBLY

[75] Inventors: James A. Millett, Fountain Valley; James W. Raymond, Newport Beach, both of Calif.

[73] Assignee: James W. Raymond, Calif.

[22] Filed: Aug. 19, 1974

[21] Appl. No.: 498,269

[52] U.S. Cl. ..... 70/363; 70/383

[51] Int. Cl.[2] ..... E05B 27/06

[58] Field of Search ..... 70/337, 338, 339, 340, 70/341, 342, 343, 363, 382, 383, 384, 385

[56] References Cited

UNITED STATES PATENTS

| | | | |
|---|---|---|---|
| 2,021,443 | 11/1935 | Deutsch | 70/363 |
| 2,024,030 | 12/1935 | Deutsch | 70/384 |
| 2,044,534 | 6/1936 | Lejbowicz | 70/383 |
| 2,390,471 | 12/1945 | Suter | 70/385 |

*Primary Examiner*—Robert L. Wolfe

[57] ABSTRACT

A cylindrical lock assembly is provided which is approximately the same size as present-day cylindrical "Mortise" locks, and which can replace present-day locks in the doors of hotels, motels, or other establishments, merely by removing the existing lock cylinders and replacing them by the lock cylinders of the invention. The lock assembly of the invention has a number of internal logic ring members which are mounted tandem to one another in coaxial relationship with the central axis of the lock, and which are replaceable to change the key pattern to which the lock will respond. The lock also includes a plurality of spring-biased tumblers, which are moved longitudinally to mating positions with respect to the various logic ring members when the proper keys are inserted in the lock. Each lock will respond, for example, to four different keys, namely, a guest key which is usually different for each lock in the establishment, a maid's key which fits a predetermined number of locks in the establishment, and an emergency key which not only fits all the locks in the establishment, but which can operate all the locks, even when a door is bolted by the usual dead bolt mechanism. In the embodiment to be described, the logic ring members can be changed only by a release operation which can be carried out only by the emergency key.

17 Claims, 7 Drawing Figures

LOCK ASSEMBLY

BACKGROUND OF THE INVENTION

The lock assembly to be described has particular, although not exclusive, utility in hotels and motels, where, for security purposes, it is often desirable to change the locks in the doors of the rooms from time to time. The lock assembly is of the same general type as described and claimed in Copending Applications Ser. No. 455,576, filed Mar. 28, 1974, in the name of James A. Millett; Ser. No. 443,310, filed Feb. 19, 1974, in the names of James W. Raymond and James A. Millett; and Ser. No. 438,867, filed Feb. 1, 1974, in the name of James W. Raymond.

The lock assembly of the invention, in the embodiment to be described, includes three replaceable logic ring members, as explained briefly above, namely a guest logic ring, a maid logic ring, and a master-emergency logic ring. As also pointed out, the guest logic rings, which are preferably different for each lock in the establishment, are operated by the keys issued to the guests; the maid logic rings, which are preferably the same for a group of locks in the establishment, are operated by keys to the maids; and the master-emergency logic rings, which are preferably the same for all the locks in the establishment, are operated by keys issued to the technicians and maintenance men of the establishment.

None of the keys mentioned above can unlock the door of any room in the establishment, if the door is bolted by the usual dead bolt mechanism, so that the security and privacy of the guests may be assured. However, a further key, termed an emergency key, is also provided. The emergency key is similar in most respects to the master key, and it operates in conjunction with the master logic ring. However, the emergency key has an additional feature, as noted above, of being able to unlock the lock even if the door is bolted by the usual dead bolt, so that access to a room under any conditions may be achieved. Also, the emergency key has the ability of setting the lock to a release position, in which the various logic rings can be removed and replaced.

DETAILED DESCRIPTION OF THE ILLUSTRATED EMBODIMENT

Figure 2:
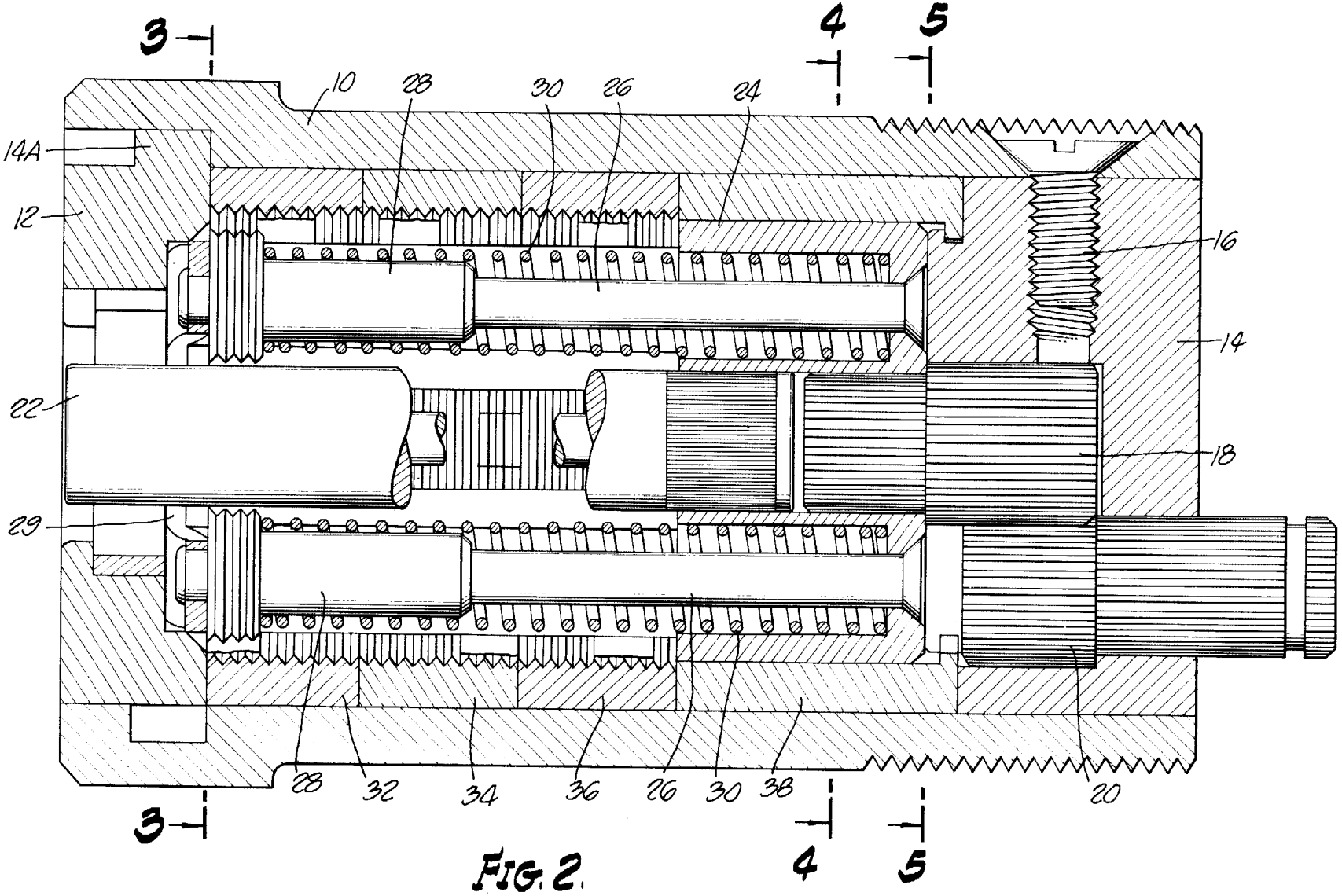
FIG. 2 is a side section taken along the line 2—2 of FIG. 1.

The lock assembly, as best shown in FIG. 2, includes an outer cylindrical casing 10, a front cover plate 12, and a gear housing 14 which encloses the rear end of casing 10. The gear housing 14 is retained on the casing 10 by means of a screw 16. A drive gear 18 is rotatably mounted in the gear houding 14 in meshing relationship with a driven gear 20. The driven gear is mechanically coupled to the door latch by any suitable means (not shown). A drive shaft 22 is mounted in a cylindrical tumbler carrier 24 which is rotatably mounted in the casing 10, and the shaft extends along the central axis of the casing in axial alignment with the axis of rotation of the drive gear 18.

The cylindrical tumbler carrier 24 is keyed to the drive shaft 22 and to the gear 18, so that rotation of the drive shaft 22 causes the tumbler carrier 24 and the gear 18 to rotate. The tumbler carrier is actually in press fit with the shaft 22 and with the gear 18, so that rotation of the shaft will rotate the carrier and the gear, as mentioned above. If the carrier is locked against rotation, the shaft cannot turn. If excessive torque is applied to the shaft when the carrier is locked, in an effort to open the door, the shaft will merely turn in the carrier and will be ineffective to turn the gear 18 or to unlatch the door.

The carrier 24 is located adjacent the inner side of gear housing 14. A plurality of tumbler shafts 26 are mounted on the carrier 24, the shafts extending longitudinally in the housing 10 along respective axes which are spaced and parallel with respect to the central axis of rotation of the carrier. A corresponding plurality of tumblers 28 are slidably mounted on the respective shafts 26, the tumblers being spring-biased to the left of FIG. 2 against the inner side a cover plate 29 by corresponding springs 30.

Three separate logic rings 32, 34 and 36 are mounted tandem to one another in the housing 10 coaxial with the axis of rotation of the drive shaft 22. The logic rings are keyed to one another and to the front plate 12 and to a clutch ring 38, so that all these elements are held within casing 10 in a fixed angular position with respect to one another. This keying is achieved by appropriate tongues and grooves, such as shown between the rings 34 and 36 in FIG. 2.

The inner surfaces of the logic rings 32, 34 and 36 are serrated, as are the outer surfaces of the tumblers 28, so as to render the lock pick-proof, as explained in the copending applications. The ring 32 is the guest logic ring, the ring 34 is the maid logic ring, and the ring 36 is the master-emergency logic ring.

The clutch ring 38 is mounted in the casing 10 concentrically with the tumbler carrier 24, and it is interposed between the logic ring 36 and the gear housing 14. As mentioned above, the clutch ring is keyed to the logic ring members, and it is turned, together with the front plate 12, whenever the logic ring members are turned within casing 10.

Figure 4:
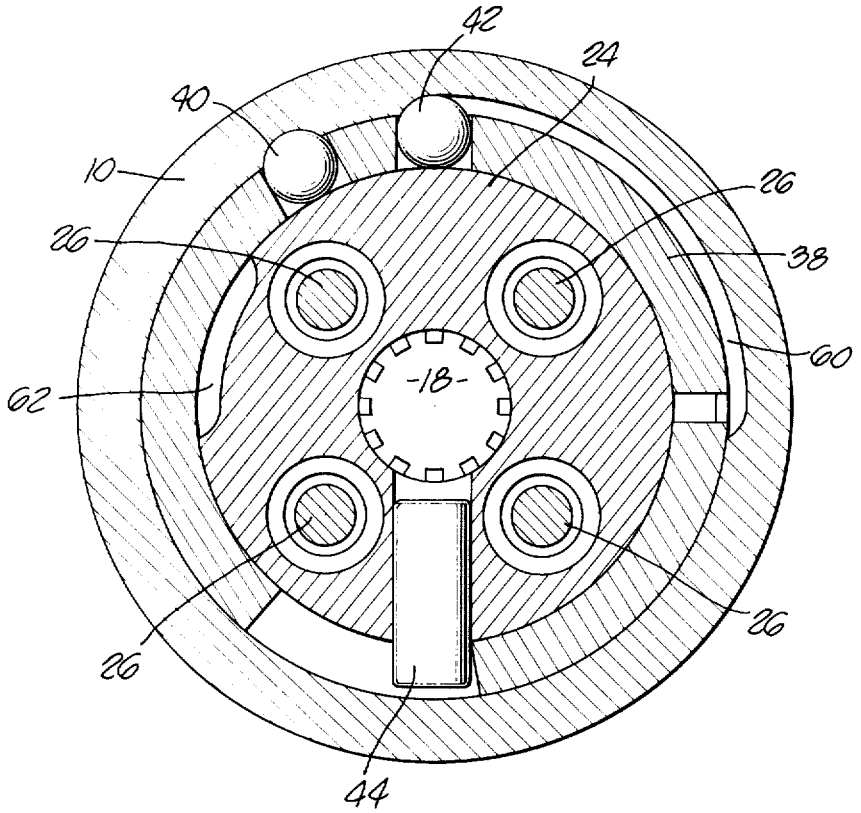
Figure 5:
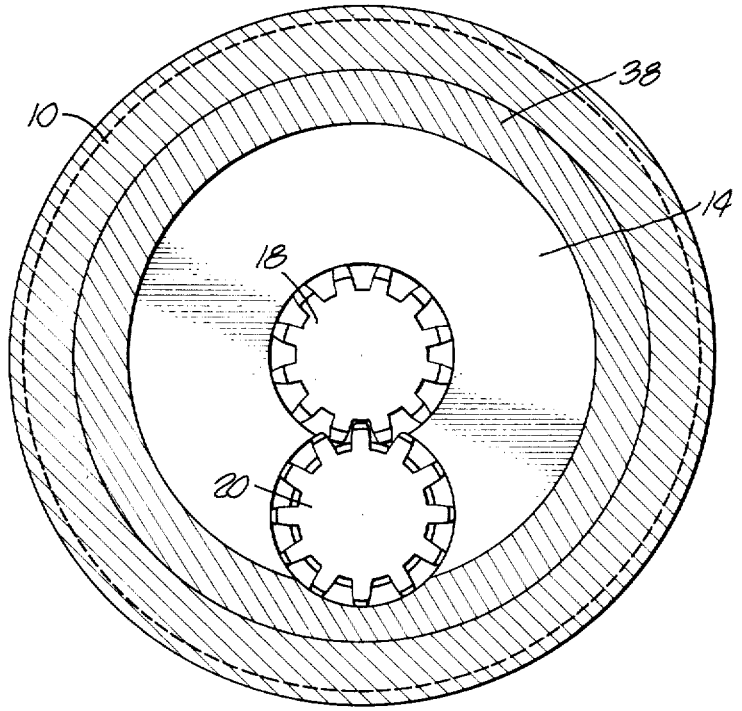

A pair of balls 40, 42 are supported in holes in the clutch ring 38, as shown in FIG. 4. The ball 40, in its illustrated position, also engages a groove on the inner surface of the casing 10, so as to prevent rotation of the clutch ring 38 within the casing.

The ball 42 rides in a groove 60 on the inner surface of the casing 10, so that, so long as the ball 42 is in its protruding position, as illustrated in FIG. 4, it limits the rotation of the clutch ring within the casing to the arcuate length of the slot 60. A timing pin 44 is supported in a radial slot in the carrier 24, and it extends into a slot in the clutch ring 38. The timing pin limits the extent of relative rotation between the carrier 24 and the clutch ring 38.

Figure 6:
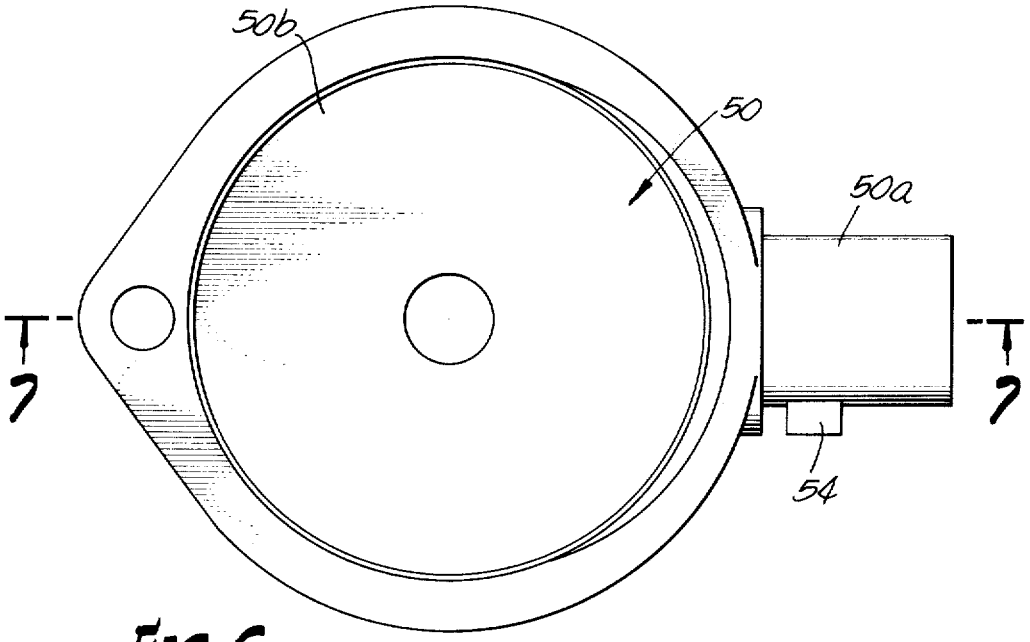
FIG. 6 is a top plan view of a key suitable for operating the lock of the invention.
Figure 7:
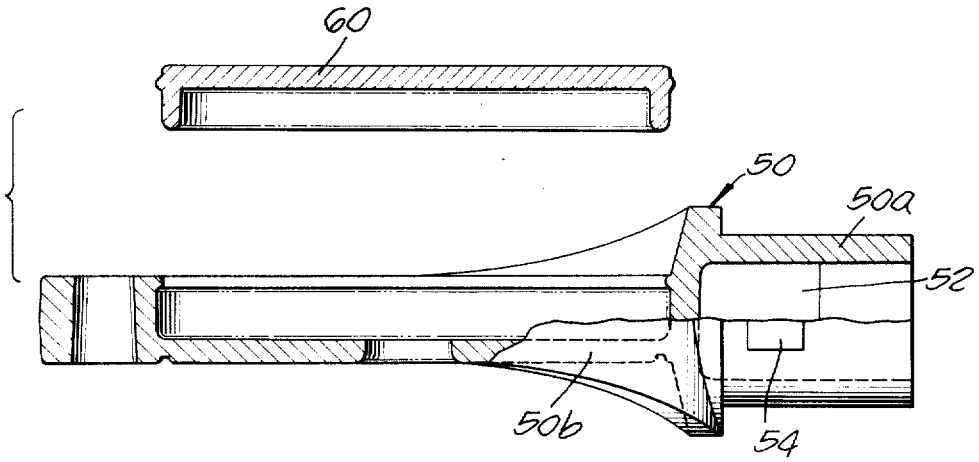
FIG. 7 is a section of the key, taken essentially along the line 7—7 of FIG. 6.

The various types of keys which are used to operated the lock assembly of the invention may be similar in shape, and all may have the configuration shown of key 50 in FIGS. 6 and 7. The key 50 has a tubular barrel section **50*a* and a disc-like handle section 50*b*. In forming the different keys, the lengths of different arcuate portions of the barrel section 50***a* are selected so that the various tumblers 28 may be pushed in against the spring-bias of the springs 30 mate the tumblers with corresponding recesses in the logic rings.

The guest keys will be relatively short, since they move the tumblers only to the guest logic ring position within the lock. The maid's key is somewhat longer than the guest key, since it moves the tumblers 28 further into the lock into preselected aligned positions with respect to recesses in the maid logic ring 34. The master key and emergency key are of equal length, and both are longer than the other two, since both of these keys move the tumblers into the lock beyond the logic rings 32 and 34, into an aligned position with respect to the master-emergency logic ring 36.

Figure 1:
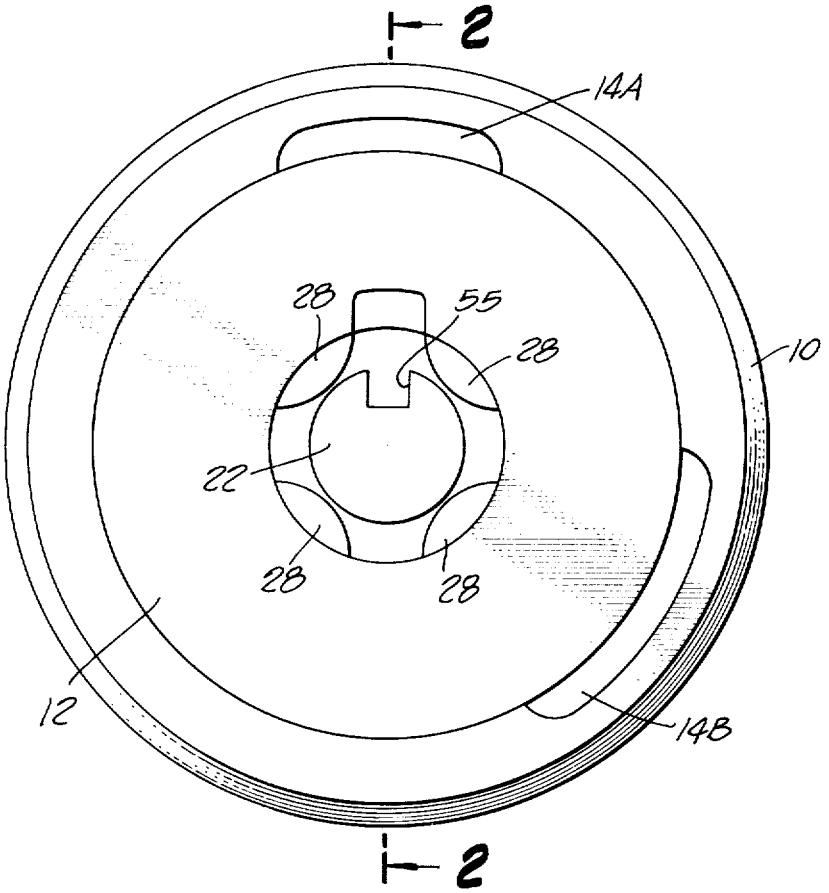
FIG. 1 is an end view of a lock assembly constructed in accordance with one embodiment of the invention.
Figure 3:
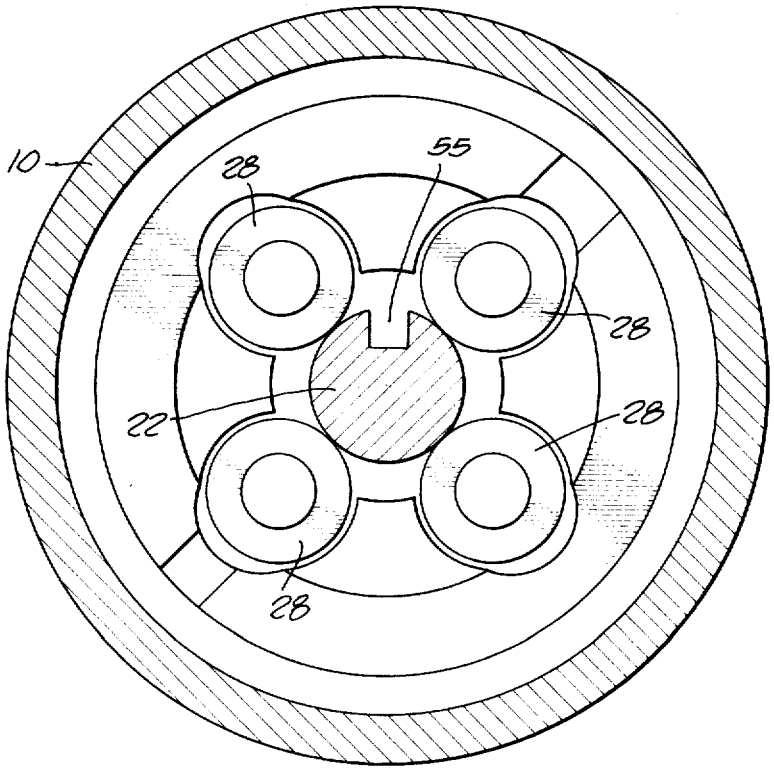
FIGS. 3, 4 and 5 are cross-sectional views taken essentially along the lines 3—3, 4—4 and 5—5 of FIG. 2, respectively.

Now, if a proper guest key is inserted into the lock, its inner projection 52 (FIG. 7) will engage a key-way 55 in the drive shaft 22 (FIGS. 1 and 3) and it will also push the tumblers 28 against the bias of springs 30 into a mating position with respect to the recesses in the guest logic ring 32. Then, when the guest key is turned, the drive shaft 22 and tumbler carrier 24 will turn in the clutch ring 38, as the tumblers move into the recesses in the guest logic ring 32.

As the carrier 24 is turned by the guest key, and as best shown in FIG. 4, the ball 40 will drop into a groove 62 in the carrier 24. The arcuate length of the recesses in the guest logic ring 32 is such, for example, that the carrier 24 can turn only 30° in the clutch ring and, the tumblers 28 will then engage the ends of the recesses in the guest logic ring, so that further rotation of the key will cause the logic rings and the clutch ring 38, together with the front plate 12 to turn in the casing 10. This turning of the clutch ring 38, and of the other elements keyed thereto, is permitted because the ball 40 has fallen into the groove 62 in the carrier, and no longer locks the clutch ring to the housing 10.

However, the amount of turning of the carrier 24 in the clutch ring is limited by the arcuate recesses in the guest logic ring 32 to such an extent that the groove 62 cannot turn to a position under the ball 42, so that the ball 42 remains in its protruded position shown in FIG. 4. Therefore, as the clutch ring 38 and the other elements keyed thereto are turned by the guest key in the casing 10, the turning of the clutch ring is limited, for example, to 60° with respect to the casing 10, at which time the ball 42 reaches the end of the groove 60. This amount of turning of the drive shaft by the key, however, is sufficient to rotate the gear 18 to the extent necessary to unlatch the door.

Then, when the guest key is turned back to its original position, the carrier 24 returns to the position shown in FIG. 4, and the ball 40 again locks the clutch ring 38 to the casing 10. Now, should the key be removed, and a wrong key inserted into the lock, any attempt to turn the drive shaft causes the tumblers to engage the corresponding logic ring, but rotation of the logic rings is prevented by the clutch ring 38, whose rotation within the casing 10 is prevented by the ball 40.

The maid's key, as mentioned above, is somewhat longer than the guest key so that when a maid's key is inserted into the lock, the tumblers 28 are moved into alignment with the maid logic ring 34. Then, if a match is achieved, the lock will be unlocked by the same action as described above. Likewise, the master key and the emergency key are somewhat longer than the maid's key, so that when either a master key or an emergency key is inserted into the lock, the tumblers 28 are moved inwardly against the spring pressure of springs 30 to an aligned position with the master logic ring 36. Again, if a match is achieved, the lock may be turned by the key to unlock the door.

Unlike the maid's and guest logic rings, the grooves in the master logic ring 36 have sufficient arcuate length to permit the carrier 24 to be turned in FIG. 4 to bring the groove 62 under the ball 42, so that balls 40 and 42 may drop into the groove. However, the master key is provided with an external radial projection 54 (FIGS. 6 and 7) and this projection engages a shoulder 56 (FIG. 2) in the front plate 12, so that the master key is incapable of turning the carrier 24 to an extent such that the ball 42 will drop into the groove 62.

However, the emergency key does not have such a radial projection 54, and it is capable of turning the carrier 24 to a sufficient distance so that both the balls 40 and 42 fall into the groove 62. When that occurs, there is no limitation upon the angular distance the carrier 24 and clutch ring 30 may be turned in the casing 10. Therefore, the emergency key permits the drive shaft 22 to be turned sufficiently to cause the driven gear 18 to unlock the dead bolt of the door through the usual unlocking mechanism, and to unlatch the door, providing access to the room, even if the dead bolt is thrown.

As the emergency key turns the clutch ring 38 an unlimited extent within the casing 10, the front plate 12 is also turned thereby, since it is keyed to the clutch ring through the logic rings. The front plate may be so turned by the emergency key to a position at which its radial lugs 14*a* and 14*b* (FIGS. 1 and 2) move into alignment with corresponding radial slots in the casing, so that the pressure of the springs 30 causes the front plate 21 to be ejected from the front of the casing, together with the logic rings 32 and 34. The logic ring 36 is still engaged by the tumblers, and it too can be removed, merely by turning it free from the tumblers and withdrawing it from the casing. In this way, the logic rings can be changed as necessary, to cause the lock to respond to a different set of keys.

The various logic rings may be color coded to indicate whether they represent the guest, maid or master-emergency logic rings. Also, the various rings may have appropriate serial numbers. The keys 50, such as shown in FIGS. 6 and 7 may be formed of appropriate metal, plastic, or other material, and they may be similarly color, and number coded.

The handle portion 50*b* of each key may have a detachable snap cover 60, so that the serial number of the logic ring corresponding to any particular key may be carried in a hidden manner inside the handle. The current room number may be indicated on the outside of the snap cover 60 of each guest key, for example, which may be changed to a new key when the guest logic is changed.

It will be appreciated that although a particular embodiment of the invention has been shown and described, modifications may be made. It is intended in the following claims to cover all the modifications which fall within the true spirit and scope of the invention.

What is claimed is:

1. A lock assembly comprising: a cylindrical shaped outer casing; a plurality of annular logic members mounted in said casing tandem to one another coaxially with the central axis of the casing; an annular clutch member mounted in said casing adjacent to one end of the logic members and coaxial with the central axis of the casing; a drive shaft mounted in said casing and extending along the central axis thereof; a tumbler carrier keyed to said drive shaft and mounted on the end thereof in nested concentric relationship with respect to said annular clutch member; a plurality of elongated tumbler shafts mounted on said carrier and extending along respective axes radially spaced from the central axis of the casing and parallel thereto; a corresponding plurality of tumblers mounted on respective ones of said tumbler shafts to be moved axially along the respective axes to selected axially aligned positions with respect to the annular logic members; and resilient means biasing said tumblers toward the forward end of the casing.

2. The lock assembly defined in claim 1, and which includes a gear housing mounted on one end of said cylindrical shaped casing; a drive gear rotatably mounted in said gear housing in axial alignment with said drive shaft and keyed to said carrier; and a further gear rotatably mounted in said gear housing in meshing relationship with said drive gear.

3. The lock assembly defined in claim 1, and which includes a first ball supported in a hole in said clutch member and in a depression in the inner surface of the housing normally to prevent relative rotation between the clutch member and the casing, and in which the logic carrier has a circumferential groove therein to receive the ball and free the clutch member when the carrier is turned to a particular angular position in the clutch member.

4. The lock assembly defined in claim 3, and which includes a second ball supported in a hole in said clutch member adjacent the first ball and received in a circumferential groove in the inner surface of the casing to permit limited angular movement of the clutch member in the casing when the first ball is received in the groove in the logic member.

5. The lock assembly defined in claim 4, in which one of the annular logic members has arcuate recesses therein for receiving the tumblers, and in which the arcuate length of the recesses is such to limit the rotation of the carrier in the clutch member to a position in which the groove in the carrier is angularly displaced from the second ball.

6. The lock assembly defined in claim 4, in which one of the annular logic members has arcuate recesses for receiving the tumblers, the arcuate length of the recesses being sufficient to permit the carrier to be turned in the clutch member an angular distance sufficient to cause the groove in the carrier to receive the second ball, so as to permit unlimited rotation of the clutch ring in the casing.

7. The lock assembly defined in claim 6, and which includes a cover plate mounted on one end of said casing and keyed to the annular logic members and to the annular clutch member for retaining the logic members in the casing, said cover plate being turnable to an angular position on the casing in which it may be ejected from the casing to permit removal of the annular logic members for replacement of the annular logic members.

8. The lock assembly defined in claim 1, and which includes a key having a tubular barrel portion for engaging said drive shaft, and having an internal projecting portion received by a key-way in the drive shaft to permit the key to turn the drive shaft when the key is turned in the casing.

9. The lock assembly defined in claim 8, in which said key has a disc-like handle portion with a hollow interior, and a disc-like cover engaging the handle portion for enclosing the interior.

10. The lock assembly defined in claim 7, and which includes a key having a tubular barrel portion with an internal projection for engaging a key-way in the drive shaft to enable the key to turn the carrier when the key is inserted into the lock, said key having a radial outer projection, and said cover plate defining a shoulder to be engaged by said projection, to limit the amount of rotation of the carrier in the casing to prevent the key from truning the carrier to an angular position at which the groove in the carrier receives the second ball, thereby preventing the cover plate from being turned to said angular position at which it may be ejected from the casing.

11. The lock assembly defined in claim 7, and which includes a key having a tubular barrel portion with an internal projection for engaging a key-way in the drive shaft to enable the key to turn the carrier to an angular position at which the groove in the carrier receives the second ball to permit the cover plate to be turned to said angular position at which it may be ejected from the casing.

12. A lock assembly comprising: a casing; a plurality of separate logic members removably mounted in the casing; a carrier rotatably mounted in the casing; and a plurality of tumblers carried by the carrier and movable axially with respect to the casing upon the insertion of a key into selective operative relationship with different ones of the logic members, in which said casing has a cylindrical shape and in which said logic members have an annular configuration and are mounted in said casing in a tandem relationship with one another coaxially with the central axis of the casing.

13. The lock assembly defined in claim 12, and which includes an annular clutch member mounted in said casing adjacent to one end of the logic members and coaxial with the central axis of the casing.

14. The lock assembly defined in claim 13, and which includes a first ball supported in a hole in said clutch member and in a depression in the inner surface of the housing normally to prevent relative rotation between the clutch member and the casing, and in which the logic carrier has a circumferential groove therein to receive the ball and to free the clutch member when the carrier is turned to a particular angular position in the clutch member.

15. The lock assembly defined in claim 14, and which includes a second ball supported in a hole in said clutch member adjacent to the first ball and received in a circumferential groove in the inner surface of the casing to permit limited angular movement of the clutch member in the casing when the first ball is received in the groove in the logic member.

16. The lock assembly defined in claim 15, in which one of the annular logic members has arcuate recesses therein for receiving the tumblers, and in which the arcuate length of the recesses is such to limit the rotation of the carrier in the clutch member to a position in which the groove in the carrier is angularly displaced from the second ball.

17. The lock assembly defined in claim 15, in which one of the annular logic members has arcuate recesses for receiving the tumblers, the arcuate lengths of the recesses being sufficient to permit the carrier to be turned in the clutch member through an angular distance sufficient to cause the groove in the carrier to receive the second ball, so as to permit unlimited rotation of the clutch ring in the casing.

* * * * *